US007607281B2

(12) United States Patent
Freddi

(10) Patent No.: US 7,607,281 B2
(45) Date of Patent: Oct. 27, 2009

(54) METHOD AND APPARATUS FOR MANUFACTURING PACKAGES OF PRODUCTS

(75) Inventor: Antonio Freddi, Reggiolo (IT)

(73) Assignee: Evifill S.R.L., San Prospero (IT)

( * ) Notice: Subject to any disclaimer, the term of this patent is extended or adjusted under 35 U.S.C. 154(b) by 0 days.

(21) Appl. No.: 11/596,621

(22) PCT Filed: Jun. 6, 2005

(86) PCT No.: PCT/EP2005/052588

§ 371 (c)(1),
(2), (4) Date: Nov. 15, 2006

(87) PCT Pub. No.: WO2005/123510

PCT Pub. Date: Dec. 29, 2005

(65) Prior Publication Data

US 2007/0220833 A1 Sep. 27, 2007

(30) Foreign Application Priority Data

Jun. 17, 2004 (IT) ..... MO04A0151

(51) Int. Cl.
*B65B 7/28* (2006.01)
*B65B 51/10* (2006.01)

(52) U.S. Cl. ..... 53/471; 53/478; 53/281; 53/329.4; 53/374.6; 53/553

(58) Field of Classification Search ..... 53/371.6, 53/374.6, 453, 471, 478, 559, 267, 281–283, 53/329.3, 329.4
See application file for complete search history.

(56) References Cited

U.S. PATENT DOCUMENTS

| | | | | | |
|---|---|---|---|---|---|
| 3,733,773 | A | * | 5/1973 | Hamilton | 53/559 |
| 3,965,656 | A | * | 6/1976 | Gerben | 53/282 |
| 4,033,092 | A | * | 7/1977 | Vetter | 53/77 |
| 4,042,148 | A | | 8/1977 | Gerben et al. | |
| RE29,937 | E | * | 3/1979 | Mahaffy et al. | 53/511 |
| 4,362,593 | A | * | 12/1982 | Grevich | 156/498 |
| 4,565,052 | A | * | 1/1986 | Hautemont | 53/453 |
| 4,726,173 | A | * | 2/1988 | Giatti | 53/559 |

(Continued)

FOREIGN PATENT DOCUMENTS

DE 21 46 835 A1 3/1973

(Continued)

*Primary Examiner*—Stephen F Gerrity
(74) *Attorney, Agent, or Firm*—Modiano & Associati; Albert Josif; Daniel J. O'Byrne

(57) ABSTRACT

A method and an apparatus for manufacturing packages of product; the apparatus according to the invention comprises elements for feeding a plurality of trays, which are arranged substantially horizontally and so that their corresponding cavities are directed upward and are distributed in a line along at least one advancement direction, along which at least one unit for filling at least one of the trays at a time and at least one unit for applying covering elements to the filled tray in order to obtain a package are arranged; the application unit can move in a reciprocating fashion along the advancement direction between an initial configuration, which substantially coincides with the longitudinal position at which the filling of the tray ends with respect to the advancement direction, and a final configuration, which is advanced with respect to the initial one, the filling unit being movable in a reciprocating manner toward and away from the longitudinal end filling position.

22 Claims, 3 Drawing Sheets

U.S. PATENT DOCUMENTS

| | | | | |
|---|---|---|---|---|
| 5,048,268 | A * | 9/1991 | Brembilla et al. | 53/511 |
| 5,269,123 | A * | 12/1993 | Marchesini | 53/559 |
| 6,843,038 | B1 * | 1/2005 | Haws | 53/133.4 |

FOREIGN PATENT DOCUMENTS

| | | | |
|---|---|---|---|
| EP | 0 347 825 | A | 12/1989 |
| FR | 1 503 378 | A | 11/1967 |

* cited by examiner

METHOD AND APPARATUS FOR MANUFACTURING PACKAGES OF PRODUCTS

The present invention relates to a method and an apparatus for manufacturing packages of products, particularly liquids, creams, pastes or the like for cosmetic, detergent, medical or food use.

BACKGROUND OF THE INVENTION

Packages, generally of the single-use type, for small doses of products are known which are constituted by a tray made of plastics or metallic material that is closed by a heat-sealable film after filling.

Various methods for obtaining these packages are known.

In particular, it is known to fill and close the trays while they are fed with a substantially horizontal arrangement and so that their cavities are directed upward.

According to a first known working method, the packages are obtained by feeding the trays along an advancement direction, along which they encounter a unit for dosing the product and a subsequent unit for applying the covering film, both units being fixed with respect to the advancement direction.

Therefore, the feeding of the trays is discontinuous and provides appropriate stationary periods at said units.

However, this packaging method is not free from drawbacks, including the fact that the repeated accelerations and decelerations to which the trays are subjected cause an agitation of the product introduced therein that increases as its viscosity decreases.

Certain refinements are known in order to avoid accidental escape of the product during transfer from the dosage unit to the film application unit.

A first known refinement consists in dosing the amount of product that is introduced in each tray so as to occupy its useful volume only partially.

The percentage of useful volume that is occupied by the product is on the order of 75% and must decrease as the ratio between the extension of the base and the depth of the cavity of the trays being used increases.

By proceeding in this way, however, one obtains packages that have some drawbacks, linked in particular to consumer appreciation.

Partial filling of the packages is in fact usually ascribed to accidental products leaks.

Moreover, the fact of using packages that are "oversized" with respect to the amount of product contained therein is sometimes deemed misleading, in that it is aimed at fooling consumers regarding the content of said packages.

As an alternative, it is possible to reduce the rate at which the trays are fed from the dosage unit to the film application unit, penalizing however the productivity and low cost of the manufacturing cycle.

In order to obviate these drawbacks, a second operating method is also known which allows to reduce the agitation of the product introduced in the tray during travel toward the film application unit.

In this case, the packages are obtained by feeding the trays along an advancement direction, along which they encounter a so-called "chaser" product dosage unit, which can move alternately along said direction, and a subsequent film application unit that is fixed with respect to said direction.

The filling unit performs a translational motion for a certain extent together with the trays during filling; directly upstream of the film application unit, filling is completed; then the dosage unit returns to its initial configuration while the filled tray continues to advance until it reaches the application unit.

However, even this operating method does not allow to achieve optimum filling of the resulting packages.

In order to further reduce the agitation of the product in the trays, it is known to increase the viscosity of said product by introducing appropriate amounts of thickening additives.

However, these additives can alter the characteristics of the product and may form deposits that remain on the bottom of the package after the product contained therein has been used up, and a perception of poor quality or deterioration of said product is sometimes associated with said deposits.

SUMMARY OF THE INVENTION

The aim of the present invention is to eliminate the drawbacks noted above of the background art, by providing a method and an apparatus for manufacturing packages of products that allow to optimize the filling of the resulting packages, increasing their level of quality and appreciation by consumers.

Within this aim, an object of the present invention is to avoid penalizing the productivity of the corresponding manufacturing cycle.

Another object of the present invention is to avoid altering the product introduced in the packages.

Another object of the present invention is to provide a structure that is simple, relatively easy to provide in practice, safe in use, effective in operation, and has a relatively low cost.

This aim and these objects are achieved by the present method for manufacturing packages of products, characterized in that it comprises the steps of:

(a) feeding a plurality of trays arranged substantially horizontally and so that their cavities are directed upward and are distributed in a line along at least one advancement direction;

(b) filling at least one of said trays at a time with a product;

(c) placing covering means on said filled tray at the longitudinal position where filling ends with respect to said advancement direction;

(d) temporarily rigidly coupling said covering means and said tray so as to obtain a package.

The aim and objects of the present invention are also achieved by an apparatus for manufacturing packages of products, which comprises means for feeding a plurality of trays, which are arranged substantially horizontally and so that their corresponding cavities are directed upward and are distributed in a line along at least one advancement direction, along which at least one unit for filling at least one of said trays at a time and at least one unit for applying covering means to said filled tray in order to obtain a package are arranged, characterized in that said application unit can move in a reciprocating fashion between an initial configuration, which substantially coincides with the longitudinal position at which the filling of the tray ends with respect to said advancement direction, and a final configuration, which is displaced with respect to the initial one, said filling unit being movable in a reciprocating manner toward and away from said longitudinal filling end position.

BRIEF DESCRIPTION OF THE DRAWINGS

Further characteristics and advantages of the present invention will become better apparent from the following detailed description of some preferred but not exclusive embodiments of a method and an apparatus for manufacturing packages of products, illustrated by way of non-limiting example in the accompanying drawings, wherein.

DESCRIPTION OF THE PREFERRED EMBODIMENT

Figure 1:
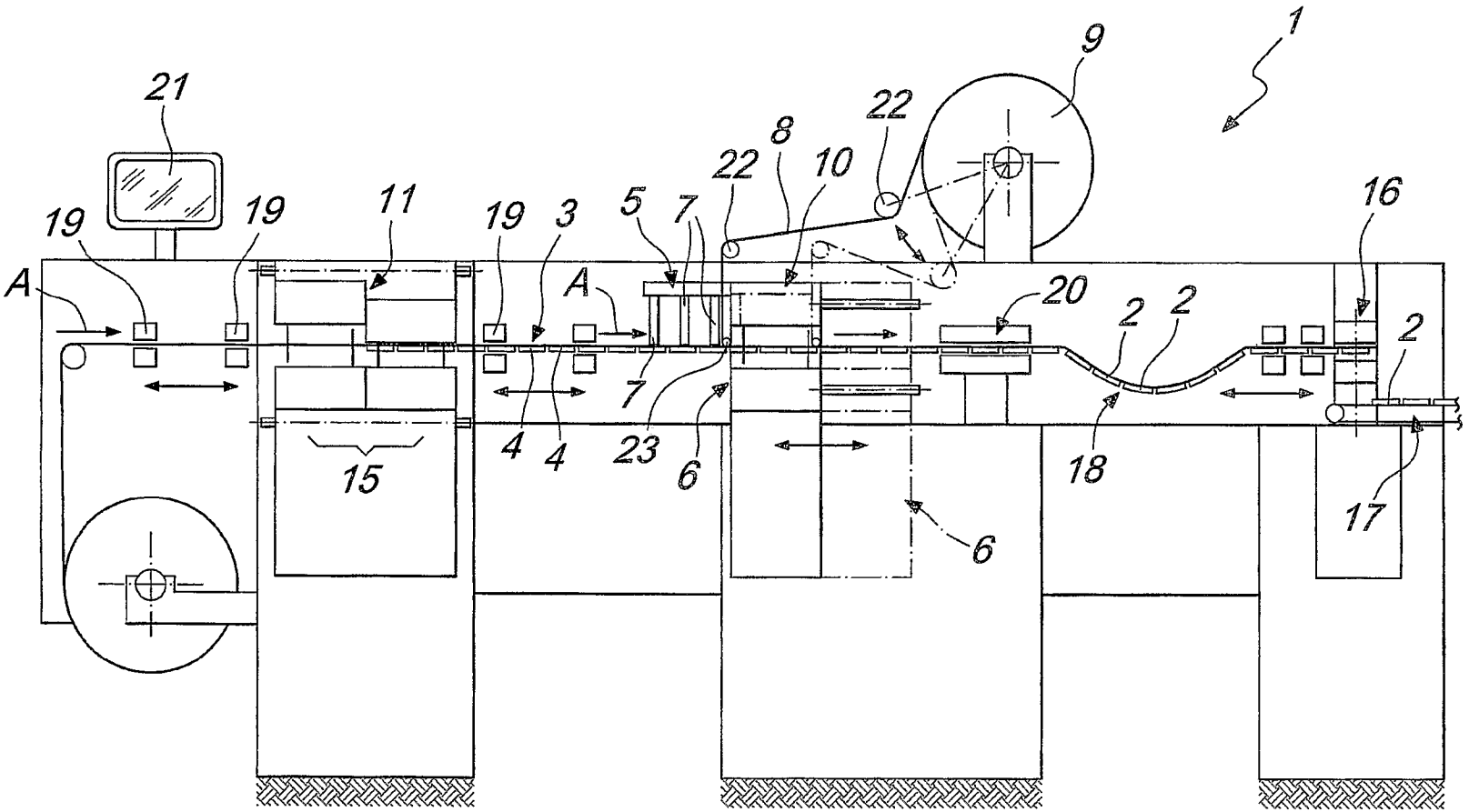
FIG. 1 is a side view of a possible embodiment of the apparatus according to the invention.

With reference to the figures, the reference numeral 1 generally designates an apparatus for manufacturing packages 2 of products, particularly liquids, creams, pastes or the like for cosmetic, detergent, medical or food use.

The apparatus 1 comprises means 3 for feeding a plurality of trays 4, which are arranged substantially horizontally and so that their corresponding cavities are directed upward and are distributed in a line along at least one advancement direction, designated by the letter A in the figures.

Along the feeder means 3, there is at least one unit 5 for filling at least one tray 4 at a time and there is at least one subsequent unit 6 for applying covering means to the filled tray 4.

According to the invention, the application unit 6 can move in a reciprocating fashion between an initial configuration, which substantially coincides with the longitudinal end filling position of the tray 4 with respect to the advancement direction A, and a final configuration, which is displaced with respect to the initial configuration.

Preferably, the application unit 6 can move in a reciprocating fashion along the advancement direction A, the final configuration being advanced with respect to the initial configuration along said direction.

Advantageously, the application unit 6 can therefore move along the advancement direction A so as to reach the longitudinal end filling position and cover the freshly filled tray 4 before it resumes a translational motion along said direction, so as to avoid accidental leaks of product and allow optimum filling of said tray.

Further, according to the invention the filling unit 5 can move in a reciprocating fashion toward and away, in a direction designated by the letter D in the figures, with respect to the longitudinal end filling position, so as to move away from said position in order to make it accessible to the application unit 6 in the initial configuration.

When the application unit 6 is arranged in the final configuration, instead, the filling unit 5 again moves to the longitudinal end filling position.

In this manner, it is therefore possible to use in an optimum manner the capacity of the trays 4, introducing a volume of product of the same order of magnitude as their geometric volume.

According to alternative embodiments of the invention, the advancement direction A and the approach and spacing direction D can be for example mutually substantially parallel or transverse and preferably perpendicular.

In particular, the filling unit 5 and the application unit 6 can perform a synchronous translational motion along the advancement direction A, which coincides with the approach and spacing direction D.

In this case, the filling unit 5 and the application unit 6 can be mutually rigidly coupled.

The filling unit 5 comprises at least one conventional nozzle 7 for dispensing the product, which is associated with corresponding means for pumping said product.

The output flow-rate of the nozzle 7 is proportional to the viscosity of the product to be introduced in the trays 4 and to the advancement rate of said trays.

The covering means comprise at least one protective film 8, which is preferably fed as a continuous film from a roll 9.

The film 8 is preferably of the heat-sealable type, made for example of coupled aluminum, the application unit 6 being provided with conventional heat-sealing means 10, which are suitable to make said film adhere to the upper edge of the tray 4.

Advantageously, the application unit 6 comprises traction means that are integrated therein, are not shown in detail, and allow to apply the film 8 to the tray 4 that has just been filled during travel from the final configuration to the initial configuration.

Conveniently, the apparatus 1 comprises a unit 11 for forming the trays 4, which is arranged upstream of the filling unit 5 along the advancement direction A.

The forming unit 11 comprises a unit 12 for feeding a thermoformable film 13, which is wound on a roll 14, and a conventional unit 15 for the thermoforming of said film so as to obtain a plurality of trays 4 arranged in a continuous ribbon and distributed with a constant pitch.

In an alternative embodiment, the forming unit 11 can provide a unit for feeding a substantially metallic film, made for example of aluminum, and a unit for performing the plastic deformation, for example by drawing, of said film so as to obtain a plurality of trays 4 arranged in a continuous ribbon and distributed with a constant pitch.

Conveniently, the apparatus 1 is provided with a conventional unit 16 for cropping the resulting packages 2 from said ribbon.

The cropped and separated packages 2 are moved away on a continuous conveyor 17.

The feeder means 3 are provided with a buffer portion 18, where the ribbon of packages 2 forms a loop that is interposed between the application unit 6 and the cropping unit 16, so that the corresponding cycle times are independent.

Further, the feeder means 3 comprise a plurality of clamps 19 for traction and tensioning, which can move in a reciprocating fashion along the advancement direction A.

Conveniently, there is a conventional unit 20 for cooling the packages 2, which is arranged downstream of the heat-sealing means 10 along the advancement direction A.

As an alternative, the feeder means 3 can feed individual preformed trays 4 made of plastics, metal or other material, which are for example rested on a continuous conveyor or the like.

Conveniently, means for adjusting the longitudinal position with respect to the advancement direction A of at least one among the forming unit 11, the filling unit 5, the application unit 6, the cooling unit 20 and the cropping unit 16 are provided so as to adjust the distance between said units so that it is a multiple of the longitudinal dimension of the trays 4 being processed.

Further, there is a unit 21 for managing and controlling the apparatus 1, which is preferably of the programmable type.

The apparatus 1 is preferably sized in order to obtain a plurality of packages 2 for each cycle, so as to optimize production costs.

In this case, the filling unit 5 comprises a plurality of nozzles 7, which are aligned along the advancement direction A, and it is possible to provide means for adjusting the relative distance between said nozzles as a function of the longitudinal dimension of the trays 4 being processed.

In the embodiment shown in FIG. 1, the apparatus 1 is sized so as to produce three packages for each cycle; the molding unit 11 therefore allows to form three trays 4 at a time; the filling unit 5 is provided with three nozzles 7 for the dosage of appropriate amounts of product inside respective trays 4; the application unit 6, at each work cycle, applies and heat-seals the film 8 onto the three trays 4 filled in the preceding cycle; and the cooling unit 20 is suitable to cool three packages 2 at a time.

The filling unit 5 and the application unit 6 are rigidly coupled in performing a reciprocating translational motion along the advancement direction A, which coincides with the approach and spacing direction D.

Movable rollers 22 are provided for tensioning the portion of film 8 that is unwound from the roll 9 in the translational motion of the filling unit 5 and of the application unit 6.

Further, there is a roller 23, which is associated to the rear of the heat-sealing means 10 with respect to the advancement direction A and keeps the film 8 so that it faces the filed trays 4 in an upper region.

FIGS. 2 to 5 illustrate successive operating steps of an apparatus 1 of the type shown in FIG. 1, with reference to an individual package 2 produced for each cycle.

Figure 2:
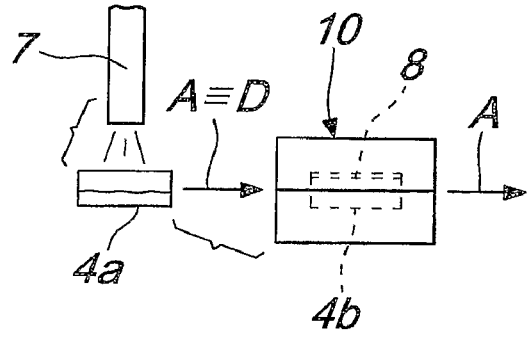
FIGS. 2 to 5 are schematic views of successive operating steps of the manufacturing cycle performed by the apparatus of FIG. 1.

In FIG. 2, the nozzle 7 is starting to fill the tray 4*a* and the heat-sealing means 10 are applying the film 8 to the tray 4*b* filled during the preceding cycle; at the same time, the nozzle 7 and the heat-sealing means 10 are performing a translational motion along the advancement direction A, which coincides with the approach and spacing direction D, at the same speed as the trays 4.

In this case, both filling and heat-sealing occur by "chasing".

During the translational motion, the tray 4*a* is filled only partially.

Figure 3:
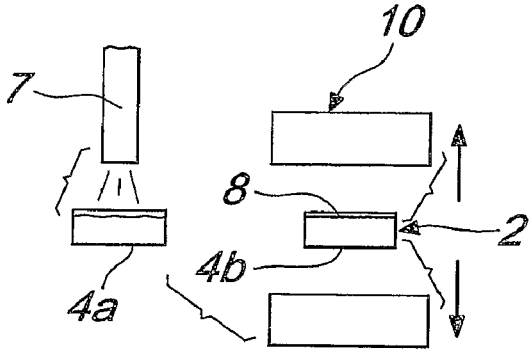

In FIG. 3, the tray 4*a* has reached the longitudinal end filling position and the feeder means 3 stop for a set time, which is sufficient to complete the filling of said tray.

Simultaneously, the heat-sealing means 10 end the application of the film 8 to the tray 4*b*, so as to obtain a package 2.

Figure 4:
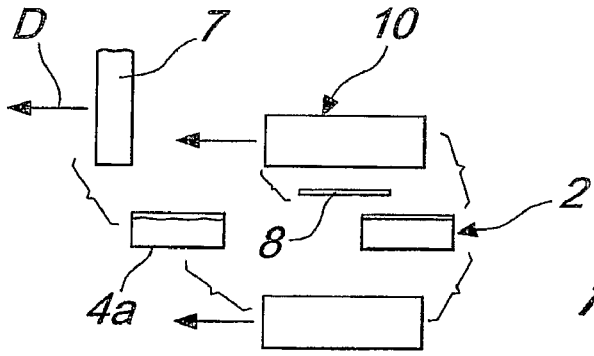

In FIG. 4, while the trays 4 are still stationary, the nozzle 7 and the heat-sealing means 10 perform a synchronous translational motion in the opposite direction with respect to the advancement direction.

The application means 6 produce a translational motion of a portion of film 8, which is used to cover the freshly-filled tray 4*a*.

Figure 5:
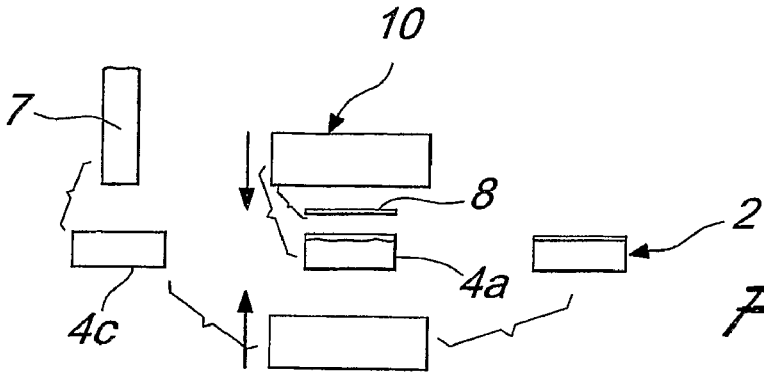

In FIG. 5, the heat-sealing means 10 have been placed at the longitudinal position at which the filling of the tray 4*a* ends together with the film 8; simultaneously, the nozzle 7 is arranged above the upstream tray 4*c*.

The trays 4, the nozzle 7 and the heat-sealing means 10 resume their translational motion along the advancement direction A, and the cycle can thus be repeated in order to fill the tray 4*c* and apply the film 8 to the tray 4*a* filled earlier.

Figure 6:
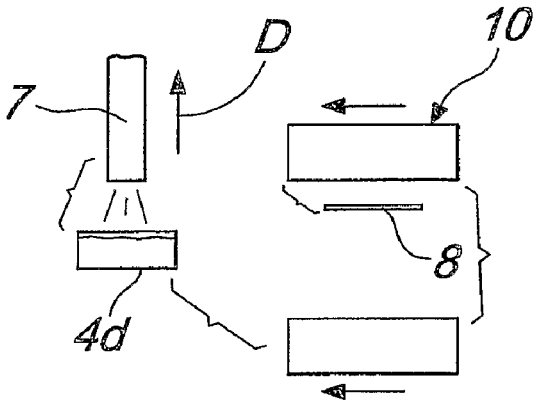
FIGS. 6 to 8 are schematic views of successive operating steps of the manufacturing cycle performed by an alternative embodiment of the apparatus according to the invention.
Figure 7:
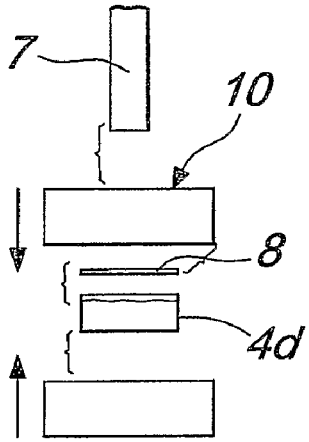
Figure 8:
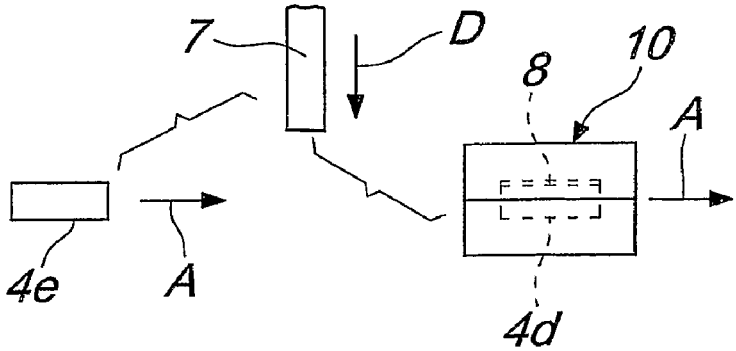

FIGS. 6 to 8 illustrate successive operating steps of the cycle for manufacturing one package 2 at a time according to an alternative embodiment of the apparatus according to the invention, in which the approach and spacing direction D is vertical and perpendicular to the advancement direction A.

In this case, the longitudinal position of the nozzle 7 with respect to the advancement direction A is fixed and coincides with the end filling position.

The feeder means 3 are of the discontinuous type; each tray 4 in fact remains stationary for a set time at the longitudinal end filling position.

In FIG. 6, the nozzle 7 has ended the filling of the tray 4*d* and rises, moving away from the longitudinal end filling position; simultaneously, the heat-sealing means 10 perform a translational motion from the final configuration to the initial configuration, drawing a portion of film 8 to cover the tray 4*d*.

Once the initial configuration has been reached (FIG. 7), which coincides with the longitudinal end filling position, the heat-sealing means 10 start to apply the film 8 to the tray 4*d* and resume their translational motion along the advancement direction A (FIG. 8); simultaneously, the nozzle 7 descends, returning to the vicinity of the longitudinal end filling position.

When, by performing a translational motion, the heat-sealing means 10 reach the final configuration, where they release the package 2 obtained from the tray 4*d*, the tray 4*e* arranged upstream is arranged below the nozzle 7 for filling.

The advancement of the trays 4 is again suspended and the cycle resumes.

In an alternative embodiment of the apparatus 1, the approach and spacing direction D can be arranged horizontally but transversely to the advancement direction.

It should be noted that the apparatus 1 has a substantially modular structure and is therefore particularly flexible as production requirements vary.

The method according to the invention, with reference to the cycle for manufacturing at least one package 2 at a time, comprises the following steps:

feeding a plurality of trays, which are arranged substantially horizontally and so that their corresponding cavities are directed upward and are distributed in a line along at least one advancement direction;

filling at least one of the trays at a time with a product;

positioning covering means on the filled tray at the longitudinal end filling position with respect to the advancement direction;

temporarily rigidly coupling the covering means and the tray so as to obtain a package.

Said covering means comprise at least one protective film, and the positioning step consists substantially in applying said film over the filled tray.

The step for temporary rigid coupling preferably comprises a step of heat-sealing the film to the perimetric edge of the tray, the film being of the heat-sealable type.

The heat-sealing step is performed at least at the longitudinal end filling position.

More preferably, the step for temporary rigid coupling consists in advancing from the longitudinal end filling position along the advancement direction, while heat-sealing is being performed, and in returning at said position.

The filling step comprises a step of dispensing a volume of product of the same order of magnitude as the geometric volume of the tray.

More preferably, the filling step consists in advancing along the advancement direction up to the longitudinal end filling position while dispensing the product inside the tray, in remaining stationary at said position until filling has been completed, and in moving away from said position in the opposite direction with respect to the advancement direction.

Advantageously, the removal and application steps are performed simultaneously.

Further, it is possible to provide the steps of forming the trays and of separating the resulting packages if the trays are fed in a ribbon.

In practice it has been found that the described invention achieves the intended aim and objects.

The invention thus conceived is susceptible of numerous modifications and variations, all of which are within the scope of the inventive concept.

All the details may further be replaced with other technically equivalent ones.

In practice, the materials used, as well as the shapes and the dimensions, may be any according to requirements without thereby abandoning the scope of the protection of the appended claims.

The disclosures in Italian Patent Application No. MO2004A000151 from which this application claims priority are incorporated herein by reference.

What is claimed is:

1. A method for manufacturing packages of products, comprising the steps of:

(a) feeding a plurality of trays arranged substantially horizontally and so that cavities of said trays are directed upward and are distributed in a line along at least one advancement direction;

(b) filling at least one of said trays at a time with a product and stopping said at least one of said trays at an end filling position, where filling ends, with respect to said advancement direction such that said at least one of said trays filled with the product at said end filling position remains stationary;

(c) placing covering means on said at least one of said trays filled with the product at said end filling position while said at least one of said trays remains stationary;

(d) temporarily rigidly coupling said covering means and said tray so as to obtain a package;

wherein said covering means comprise at least one protective film and in that said placing step comprises the step of applying said film to said tray, and wherein said step of temporary rigid coupling comprises a step of heat-sealing said film to said tray, the film being of the heat-sealable type and wherein said heat-sealing step is performed by a heat sealing means at least at said end filling position, and wherein said step of temporary rigid coupling comprises a step of advancing said heat sealing means from said end filling position along said advancement direction, which is performed simultaneously with said heat-sealing step, and a step for returning said heat sealing means to said end filling position.

2. A method for manufacturing packages of products, comprising the steps of:

(a) feeding a plurality of trays arranged substantially horizontally and so that cavities of said trays are directed upward and are distributed in a line along at least one advancement direction;

(b) filling at least one of said trays at a time with a product and stopping said at least one of said trays at an end filling position, where filling ends, with respect to said advancement direction such that said at least one of said trays filled with the product at said end filling position remains stationary;

(c) placing covering means on said at least one of said trays filled with the product at said end filling position while said at least one of said trays remains stationary;

(d) temporarily rigidly coupling said covering means and said tray so as to obtain a package;

wherein said filling step comprises a step of dispensing a volume of product of the same order of magnitude as a geometric volume of said tray, and wherein said filling step comprises a step of moving a filling means up to said end filling position along said advancement direction and a step of maintaining said filling means stationary at said position, and a step of moving said filling means away from said end filling position in the opposite direction with respect to said advancement direction.

3. The method of claim 2, wherein said step of moving said filling means away and said placing step are performed simultaneously.

4. An apparatus for manufacturing packages of products, comprising:

means for feeding a plurality of trays arranged substantially horizontally and so that corresponding cavities of said trays face upward and are distributed in a line along at least one advancement direction;

at least one filling unit for filling at least one of said trays at a time, said filling unit being adapted to fill said at least one of said trays at least at an end filling position, where filling ends, with respect to said advancement direction such that said at least one of said trays filled with the product at said end filling position remains stationary until said trays are closed;

at least one application unit for applying covering means to filled trays in order to obtain a package, wherein said application unit is adapted to move in a reciprocating fashion between an initial configuration, which substantially coincides with said end filling position of the tray with respect to said advancement direction, and a final configuration, which is displaced with respect to the initial one, said filling unit being movable in a reciprocating fashion toward and away from said end filling position, and said application unit being adapted to apply said covering means to said filled trays at said initial configuration substantially coinciding with said end filling position when said filled trays remain stationary.

5. The apparatus of claim 4, wherein said application unit can move in a reciprocating fashion along said advancement direction, the final configuration being advanced with respect to the initial configuration.

6. The apparatus of claim 4, wherein reciprocating motion of said filing unit occurs along an approach and spacing direction, said approach and spacing direction and said advancement direction being mutually substantially parallel.

7. The apparatus of claim 4, wherein reciprocating motion of said filling unit occurs along an approach and spacing direction, said approach and spacing direction and said advancement direction being mutually substantially transverse.

8. The apparatus of claim 4, wherein said filling unit and said application unit perform a substantially synchronous translational motion along an approach and spacing direction substantially coinciding with the advancement direction.

9. The apparatus of claim 8, wherein said filling unit and said application unit are mutually rigidly coupled.

10. The apparatus of claim 4, wherein said covering means comprise at least one protective film.

11. The apparatus of claim 10, wherein said application unit comprises means for drawing said film, which are suitable to arrange it on the filled tray in the stroke from said final configuration to said initial configuration.

12. The apparatus of claim 10, wherein said film is of the heat-sealable type, the application unit being provided with heat-sealing means.

13. The apparatus of claim 12, further comprising a unit for forming said trays.

14. The apparatus of claim 13, wherein said forming unit comprises a unit for feeding a thermoformable film and a unit for thermoforming said film so as to obtain said trays, said trays being fed in a ribbon.

15. The apparatus of claim 13, wherein said forming unit comprises a unit for feeding a substantially metallic film and a unit for the plastic deformation of said film so as to obtain said trays, said trays being fed in a ribbon.

16. The apparatus of claim 15, further comprising a unit for cropping the resulting packages from said ribbon.

17. The apparatus of claim 16, wherein said feeding means comprise a buffer portion, which is interposed between said application unit and said cropping unit.

18. The apparatus of claim 15, further comprising a unit for cooling the resulting package, which is arranged downstream of said heat-sealing means along said advancement direction.

19. The apparatus of claim 18, further comprising means for adjusting a longitudinal position, with respect to said advancement direction, of at least one among said forming unit, said filling unit, said application unit, said cooling unit and a blanking unit.

20. The apparatus of claim 4, wherein said feeding means comprise a plurality of traction and tension clamps, which can move in a reciprocating fashion along said advancement direction.

21. A method for manufacturing packages of products, comprising the steps of:

(a) feeding a plurality of trays arranged substantially horizontally and so that cavities of said trays are directed upward and are distributed in a line along at least one advancement direction;

(b) filling at least one of said trays at a time with a product and stopping said at least one of said trays at an end filling position, where filling ends, with respect to said advancement direction such that said at least one of said trays filled with the product at said end filling position remains stationary;

(c) placing covering means on said at least one of said trays filled with the product at said end filling position while said at least one of said trays remains stationary;

(d) temporarily rigidly coupling said covering means and said tray so as to obtain a package;

said step of temporary rigidly coupling comprising a step of heat-sealing said covering means to said tray, said heat-sealing step being performed by a heat sealing means at least at said end filling position; and said step of temporary rigid coupling comprising a step of advancing said heat sealing means from said end filling position along said advancement direction, which is performed simultaneously with said heat-sealing step, and a step for returning said heat sealing means to said end filling position.

22. A method for manufacturing packages of products, comprising the steps of:

(a) feeding a plurality of trays arranged substantially horizontally and so that cavities of said trays are directed upward and are distributed in a line along at least one advancement direction;

(b) filling at least one of said trays at a time with a product and stopping said at least one of said trays at an end filling position, where filling ends, with respect to said advancement direction such that said at least one of said trays filled with the product at said end filling position remains stationary;

(c) placing covering means on said at least one of said trays filled with the product at said end filling position while said at least one of said trays remains stationary;

(d) temporarily rigidly coupling said covering means and said tray so as to obtain a package;

wherein said filling step comprises a step of moving a filling means up to said end filling position along said advancement direction and a step of maintaining said filling means stationary at said position, and a step of moving said filling means away from said end filling position in the opposite direction with respect to said advancement direction.

* * * * *